US007673659B2

(12) United States Patent
Burkholder

(10) Patent No.: US 7,673,659 B2
(45) Date of Patent: Mar. 9, 2010

(54) SPILL AVOIDANCE SYSTEM AND VENTING SYSTEM FOR A STORAGE TANK USING PRESSURE TRANSFER METHODS

(76) Inventor: Steve Burkholder, 1324 Fishing Creek Rd., Annapolis, MD (US) 21403

( * ) Notice: Subject to any disclaimer, the term of this patent is extended or adjusted under 35 U.S.C. 154(b) by 1044 days.

(21) Appl. No.: 11/302,199

(22) Filed: Dec. 14, 2005

(65) Prior Publication Data

US 2007/0144612 A1 Jun. 28, 2007

(51) Int. Cl.
*B65B 1/30* (2006.01)

(52) U.S. Cl. ..... 141/206; 141/59; 141/302; 220/86.2; 220/746

(58) Field of Classification Search ..... 141/5, 141/46, 59, 95, 198, 206, 286, 302, 389; 220/86.2, 746

See application file for complete search history.

(56) References Cited

U.S. PATENT DOCUMENTS 4,441,533 A * 4/1984 Snyder et al. ..... 141/59
4,526,216 A * 7/1985 Lake, Jr. ..... 141/348
4,700,864 A 10/1987 Galles
4,765,504 A 8/1988 Sherwood et al.
4,836,835 A * 6/1989 Harris et al. ..... 96/113
5,271,438 A * 12/1993 Griffin et al. ..... 141/59
5,297,595 A * 3/1994 Haile et al. ..... 141/59
5,570,730 A * 11/1996 Keehn et al. ..... 141/59
5,730,194 A 3/1998 Foltz
6,729,367 B2 5/2004 Peterson

* cited by examiner

*Primary Examiner*—Gregory L Huson
*Assistant Examiner*—Jason K Niesz
(74) *Attorney, Agent, or Firm*—Sughrue Mion, PLLC

(57) ABSTRACT

A system for preventing overflow in a storage tank which is fillable via a nozzle inserted in a fill passage includes a nozzle stop such that when an end of the nozzle contacts the nozzle stop, the nozzle is in a fill position. The system also includes a sealing device within the fill passage, which forms an inner sealing space via a first seal around the nozzle below a hole in the nozzle and a second seal around the nozzle above the hole in the nozzle. An airtight passage connects the inner sealing space to an interior of the storage tank. The system may also include a venting system including a tank vent passage between the storage tank and an end of the fill passage and an atmospheric vent passage between the tank vent passage and the external atmosphere.

10 Claims, 12 Drawing Sheets

SPILL AVOIDANCE SYSTEM AND VENTING SYSTEM FOR A STORAGE TANK USING PRESSURE TRANSFER METHODS

BACKGROUND OF THE INVENTION

1. Field of the Invention

Apparatuses and methods consistent with the present invention are generally related to storage tanks and are specifically related to storage tank filling systems which prevent overflow during and subsequent to filling and to storage tank venting systems for venting a storage tank to the atmosphere efficiently and environmentally.

2. Description of the Related Art

It is well known to use storage tanks for holding a variety of fluids such as oil, gasoline, and diesel fuel to name a few. Proper filling of storage tanks is a universal concern, as overfilling of storage tanks may result in spillage, damage to the tank or filling equipment, contamination of land or ground water, or other serious and potentially dangerous results. Concerns over spillage of the tank contents are particularly acute when the tank contents are flammable, toxic and/or environmentally hazardous.

Spillage from fuel tanks on pleasure boats and other marine vessels is particularly troublesome. Some contemporary estimates of such fuel spillage are in excess of six million gallons annually in the United States alone. Globally, fuel spillage is many times this amount. The resultant fuel losses are economically and ecologically detrimental in terms of wasted fuel resources and environmental contamination.

An internal fuel tank on a marine vessel is typically provided with a vent to enable vapor and fumes to escape under pressure while fuel is being pumped into the fuel tank via the fuel fill tube. As the engine consumes fuel, air is drawn into the tank via the air vent to fill the space from the consumed fuel. Venting is also necessary to accommodate expansion of the fuel when it is heated. Conventionally, during filling of the fuel tank, some fuel may be discharged through the vent into the water as the attendant attempts to fill the tank to capacity. In fact, it is not unknown for filling attendants to purposely fill the tank until fuel is discharged from the vent, using this as an indication that the tank is completely full. It is also possible that fuel may be discharged through the vent subsequent to filling. For example, fuel can be discharged through the vent in a tank filled to capacity as a result of the boat listing from side to side due to waves, wind or other causes. Also conventionally, fuel may be discharged through the vent in a tank filled to capacity if a subsequent rise in ambient temperature causes the fuel to expand.

The use of fuel dispensing nozzles that automatically shut off the flow of fuel to the tank when the tank is full have been used to avoid fuel spillage during filling. These nozzles typically operate by sensing a pressure change at an end of the nozzle that results from fuel backing up within the tank fill tube. Use of a fuel dispensing nozzle with automatic shut-off will prevent fuel discharge through the fill tube during filling if the fill tube is properly designed to trigger the shut-off at the appropriate time. However, with many designs the automatic shut-off may be triggered only to have fuel surge out of the vent or out of the tank fill tube because of pressure trapped in the tank. Because of the location of the vent in many applications, it is also possible that fuel will be discharged through the vent during filling. Discharge through the vent may also occur after filling, even if the automatic shut-off is triggered. For example, if the tank is filled to near capacity, fuel can be discharged through the vent due to boat listing or fuel expansion.

A conventional nozzle 10 is illustrated in FIG. 1. Fuel is pressurized in the nozzle passage 1 by a pump (not shown). The flow of fuel is blocked in the nozzle 10 by a valve 3 that is held in a closed position by a spring 2. The valve 3 is connected to a hand-operated trigger 4 at a pivot point 5. The trigger 4 is also connected to a piston 6 at a second pivot point 7. The piston 6 is locked in a dispensing position by a pin 8 that forces balls 9 into a groove in the nozzle housing 11. The pin 8 is connected to a diaphragm 12 that is held in position by a second spring 13. When fuel is dispensed, the trigger 4 is lifted, lifting the pivot point 5 and the valve 3, allowing fuel to flow. The fuel travels to a venturi 15 where a spring loaded ball and seat create a vacuum in the passage 16 that is in communication with the diaphragm 12. The passage 16 is also open to atmospheric pressure through a hole 17 near the end of the dispensing nozzle. When fuel is being dispensed, the pressure in the passage 16 is lowered by the venturi 15, but is replaced by atmospheric pressure through the hole 17 in the nozzle. During conventional automatic shut-off, when the hole 17 is covered by fuel surging up from the tank's fill tube, the pressure drops in the passage 16, drawing the diaphragm 12 against the second spring 13, and the pin 8 is lifted from its locking position. Thus, the piston 6 moves to release the pivot point 7 in the trigger. When the pivot point 7 is moved, the trigger 4 is ineffective and the spring 2 pushes the valve 3 into the closed position, stopping the flow of fuel.

Some prior approaches to preventing spillage rely on the use of a reservoir designed to capture overflow. However, these approaches require additional parts and the use of a reservoir takes up more space on the vessel. None of these approaches addresses the above-mentioned drawbacks of relying on the automatic shut-off feature of existing fuel dispensing nozzles.

Accordingly, there is a need for a system and method that prevents spillage both during and after filling of a storage tank. It would be desirable to have such a system and method of overflow prevention that facilitates use of automatic shut-off nozzles and does not require provision of an overflow reservoir.

SUMMARY OF THE INVENTION

According to an exemplary embodiment of the present invention, a system for preventing overflow in a storage tank which is fillable via a nozzle inserted in a fill passage, includes a nozzle stop, a sealing device, and an airtight passage. The nozzle stop is disposed within the fill passage, and when an end of the nozzle is in contact with the nozzle stop, the nozzle is in a fill position. The nozzle stop may have an inner lip, wherein an inner diameter of the inner lip is smaller than an outer diameter of the end of the nozzle. The sealing device is disposed within the fill passage, above the nozzle stop. The sealing device includes a first inner seal and a second inner seal, disposed, respectively, below and above a hole in the nozzle when the nozzle is in the fill position. The first seal and the second seal form a first sealing space around the hole in the nozzle. The airtight passage is an airtight passage between the inner sealing space and an interior of the storage tank.

According to one exemplary aspect of the present invention, the sealing device may further include a hole disposed between the first inner seal and the second inner seal, a first outer seal below the hole, and a second outer seal above the hole, thus forming an outer sealing space in communication with the inner sealing space. The airtight passage may include the hole in the sealing device, the outer sealing space, a hole in the fill passage, and a pressure transfer passage between the hole in the fill passage and the storage tank.

According to another exemplary aspect of the present invention, the sealing device may further include a passage therein between the inner sealing space and the fill passage. The airtight passage may then include the passage in the sealing device, and a pressure transfer passage, within the fill passage, between the sealing device and an interior of the storage tank.

According to another exemplary embodiment of the present invention, a venting system for a storage tank fillable via a nozzle, includes a fill passage, a fill fitting, a positioning sleeve, a tank vent passage, and an atmospheric vent passage. The fill passage connected the storage tank to an external atmosphere and has a hole therein. The fill fitting includes a sleeve fitted within the fill passage and has a hole therein corresponding to the hole in the fill passage. The positioning sleeve is disposed within the fill fitting and has a substantially cylindrical central portion with an inner diameter larger than an outer diameter of the nozzle. The positioning sleeve also has an upper flange with at least one hole therein, and a lower flange. The holes in the fill passage and in the fill fitting lie between the upper and lower flanges of the positioning sleeve. The tank vent passage is a passage between the storage tank and the hole in the fill passage, such that the storage tank communicates with the external atmosphere via the tank vent passage, the hole in the fill passage, the hole in the fill fitting, and the hole in the upper flange of the positioning sleeve. The atmospheric vent is a passage between the tank vent passage and the external atmosphere. The atmospheric vent passage is connected to the tank vent passage via first and second valves. The first valve is a check valve which permits passage of air from the atmosphere to the tank vent passage, but which does not permit passage of air from the tank vent passage to the atmosphere. The second valve is a pressure relief valve which permits passage of air at a pressure of greater than or equal to a specific pressure from the tank vent passage to the atmosphere and prevents passage of air at a pressure of less than the specific pressure.

The specific pressure may be 1 psi or greater.

BRIEF DESCRIPTION OF THE DRAWINGS

The above and other exemplary aspects of the present invention will become better understood with reference to the following description and accompanying drawings, which should not be read to limit the invention in any way, in which.

DETAILED DESCRIPTION OF EXEMPLARY EMBODIMENTS OF THE INVENTION

Figure 2:
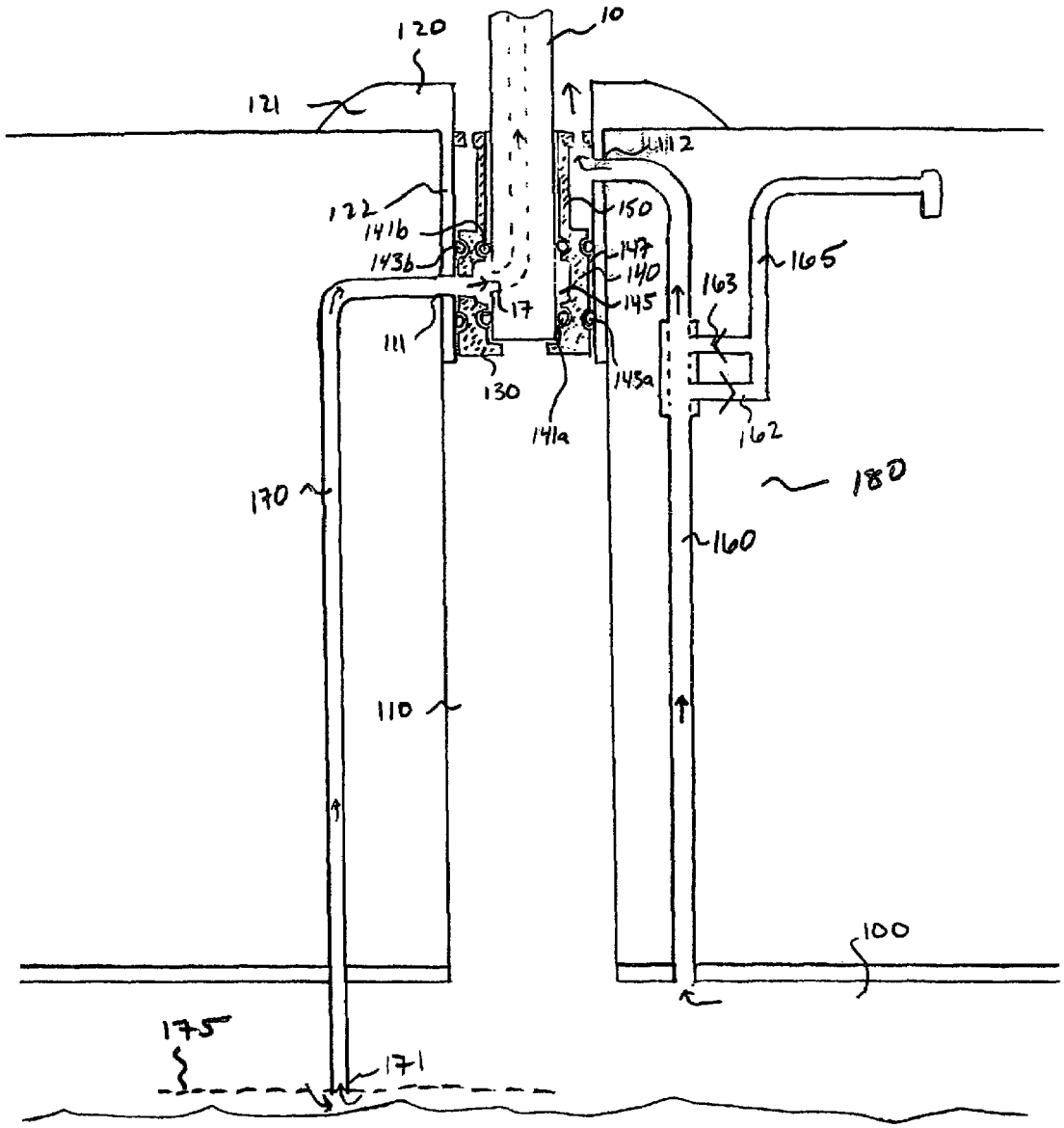
FIG. 2 illustrates a fuel spill avoidance system according to a first exemplary embodiment of the present invention.

FIG. 2 illustrates an exemplary fuel spill avoidance system according to the present invention.

As illustrated, a fuel tank 100 connects to a fill passage 110 through which the fuel tank 100 may be filled. The term "fill passage" refers to a passage from a storage tank to the exterior of a vehicle for the purposes of filling the storage tank. It may also be referred to as a fill hose. The fill passage 110 may be flexible. It should be understood that the present invention is not limited to fuel tanks, but may include another type of tank to be filled, as would be understood by one of skill in the art.

Figure 1:
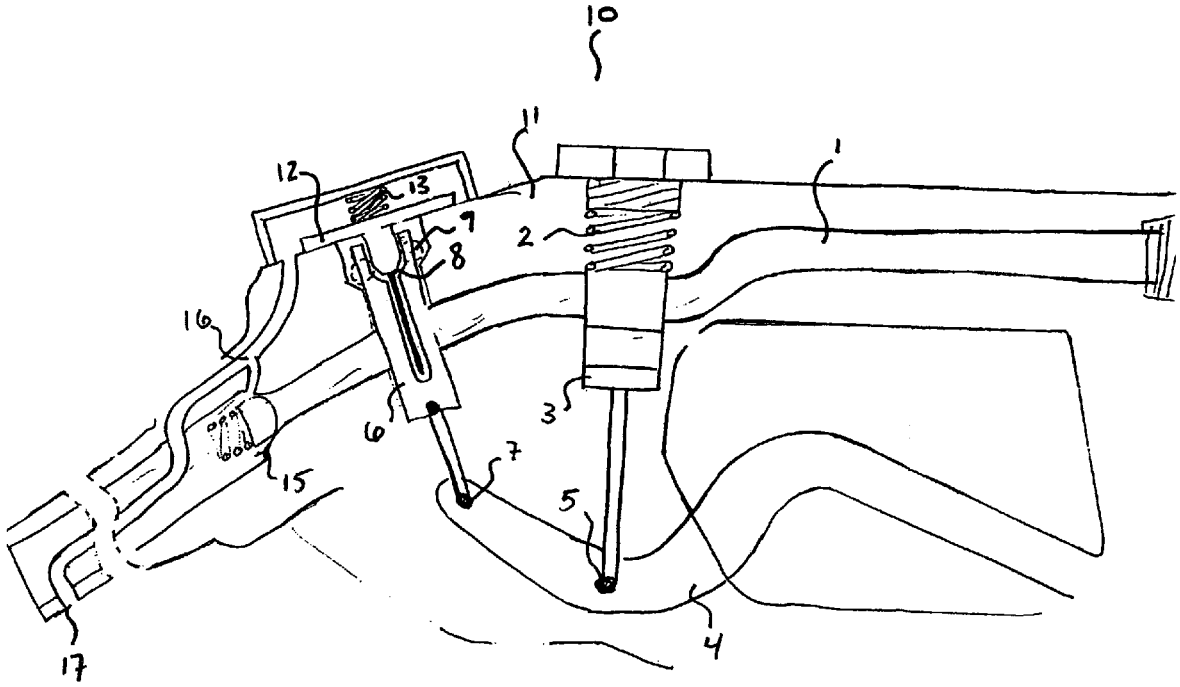
FIG. 1 illustrates a conventional nozzle.
Figure 3:
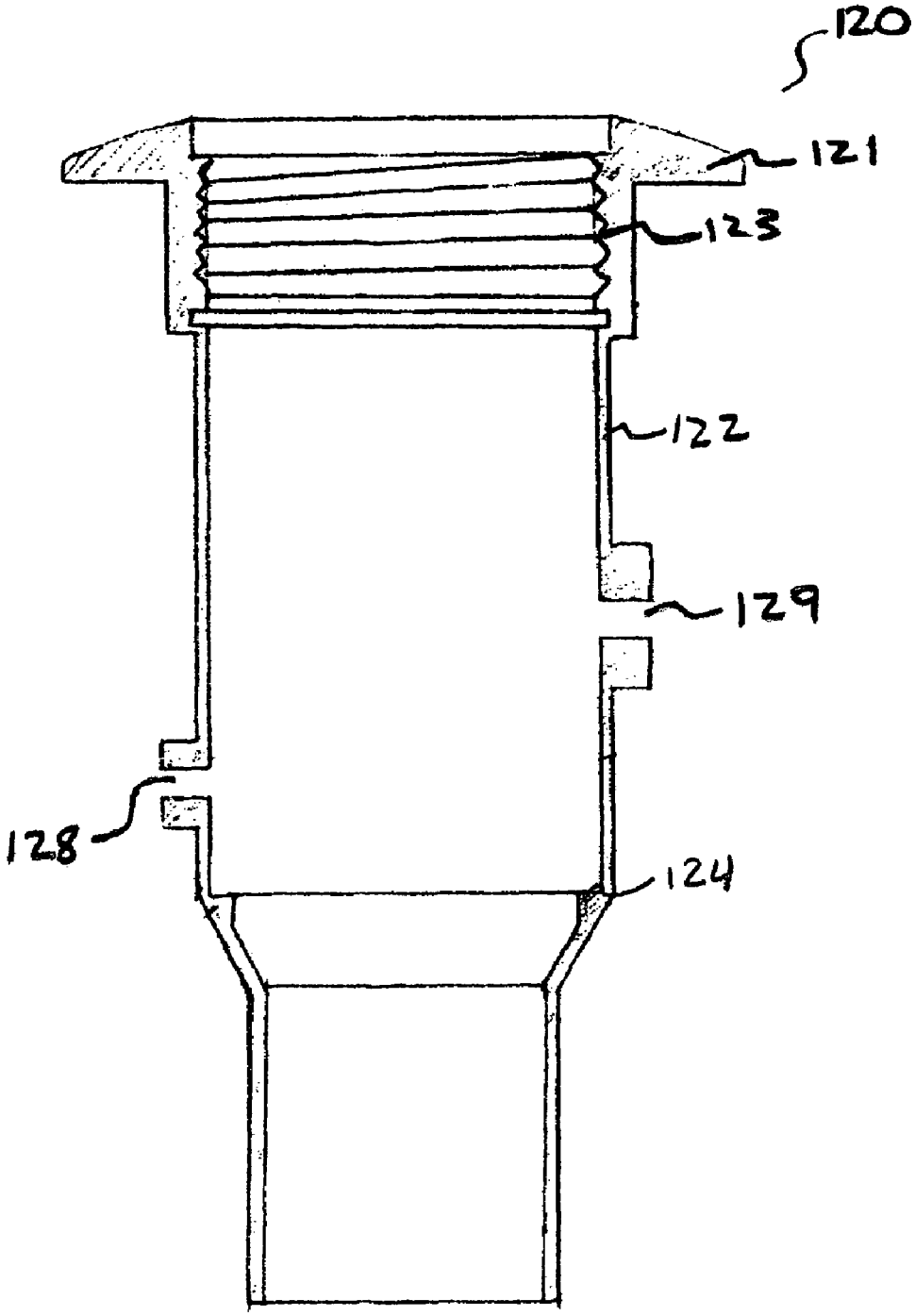
FIG. 3 illustrates a fill fitting according to an exemplary aspect of the present invention.
Figure 4:
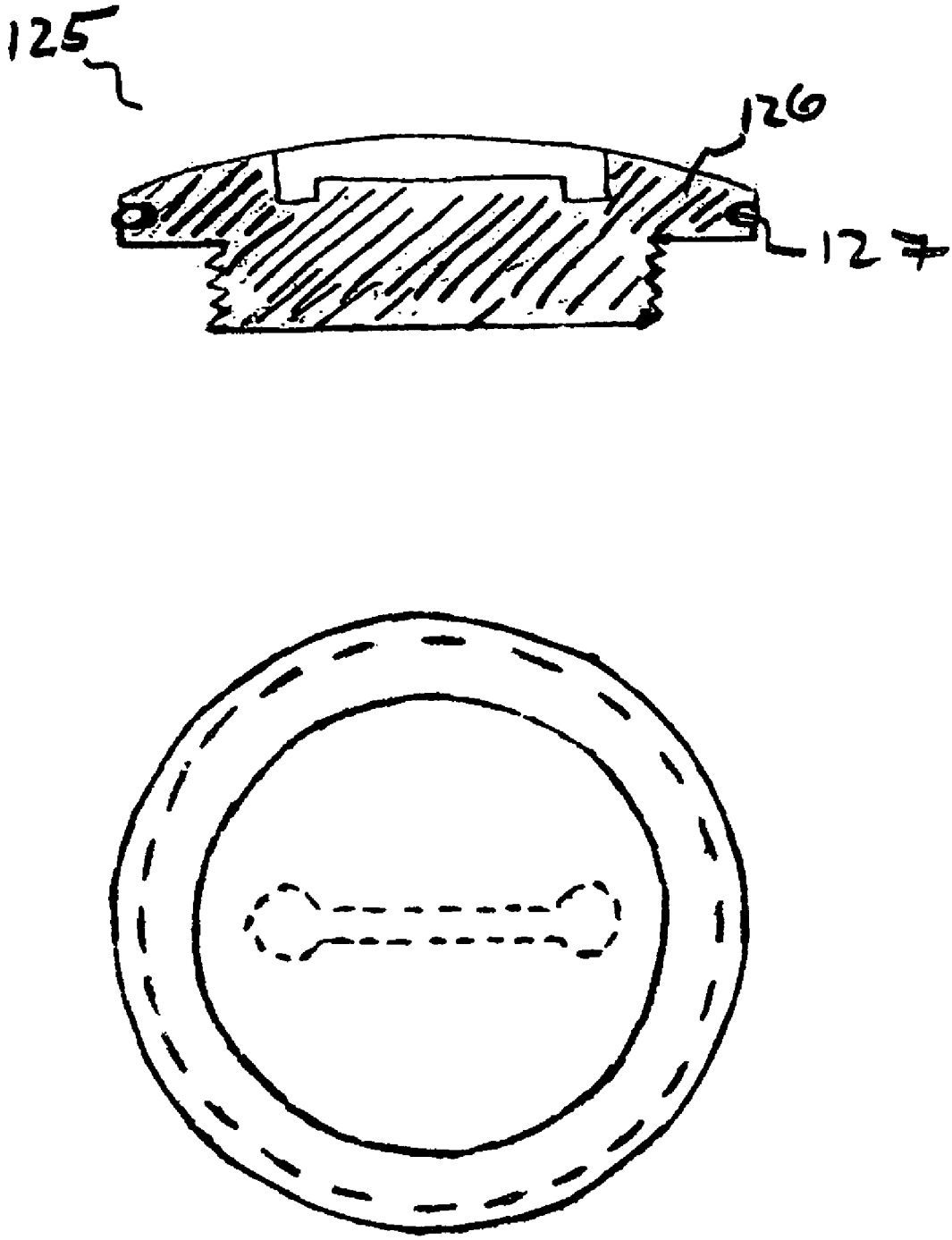
FIG. 4 illustrates a sealing cap according to an exemplary aspect of the present invention.

A fill fitting 120 is mounted in an outer end of the fill passage to receive a fill nozzle, for example nozzle 10, as illustrated in FIG. 1. An exemplary fill fitting is also illustrated in FIG. 3. The fill fitting 120 includes a flange portion 121 and a sleeve extension 122. The flange portion 121 may include a mounting flange, that sits around the outer end of the fill passage, and an inner threaded portion 123, which can receive a sealing cap 125, as illustrated in FIG. 4. The sealing cap may include a threaded cap 126 and a sealing o-ring 127, which, in conjunction with the fill fitting, seals the exterior end of the fill passage. Alternately, any other method, as would be understood by one of skill in the art may be used to seal the upper end of the fill passage 110.

The sleeve extension 122 of the fill fitting 120 fits inside the fill passage 110. A stop 124 and holes 128 and 129 in the fill fitting will be described further in conjunction with the sealing device and nozzle stop, below.

Figure 5:
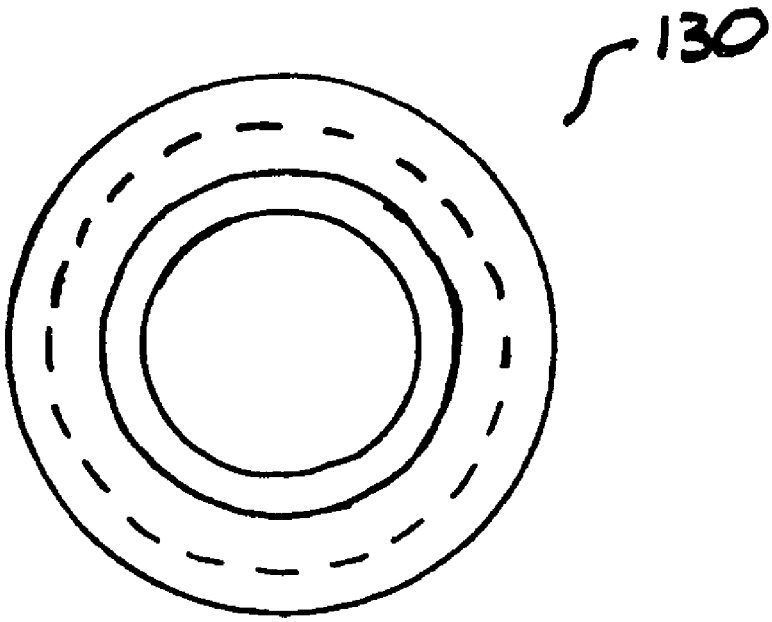
FIG. 5 illustrates a nozzle stop according to an exemplary aspect of the present invention.
Figure 5:
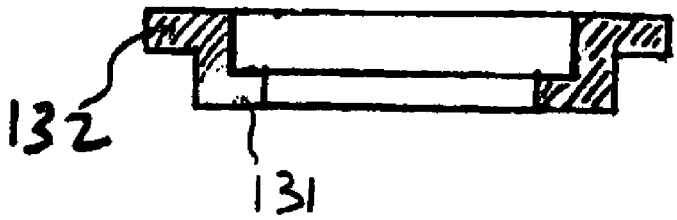

A nozzle 10 inserted into the open end of the fill passage 110 within the fill fitting 120 is stopped in a fill position by a nozzle stop 130. An exemplary nozzle stop is illustrated in FIG. 5. The nozzle stop 130 includes an inner lip 131 and an outer lip 132. The nozzle stop 130 is positioned within the fill fitting 120 so that the outer lip 132 rests on the stop 124 within the fill fitting 120. The inner lip 131 of the nozzle stop is formed so that the end of a nozzle inserted into the fill tube rests against the inner lip 131 of the nozzle stop 130 in order to properly position the height of the nozzle 10 in a fill position, as discussed below. The nozzle stop may also comprise any means, as would be understood by one of skill in the art, of stopping insertion of the nozzle once the nozzle has reached an appropriate fill position. Alternately, the nozzle stop 130 may be eliminated and the stop 124 within the fill fitting 120 may serve to stop an inserted nozzle 10 in the fill position.

Figure 6:
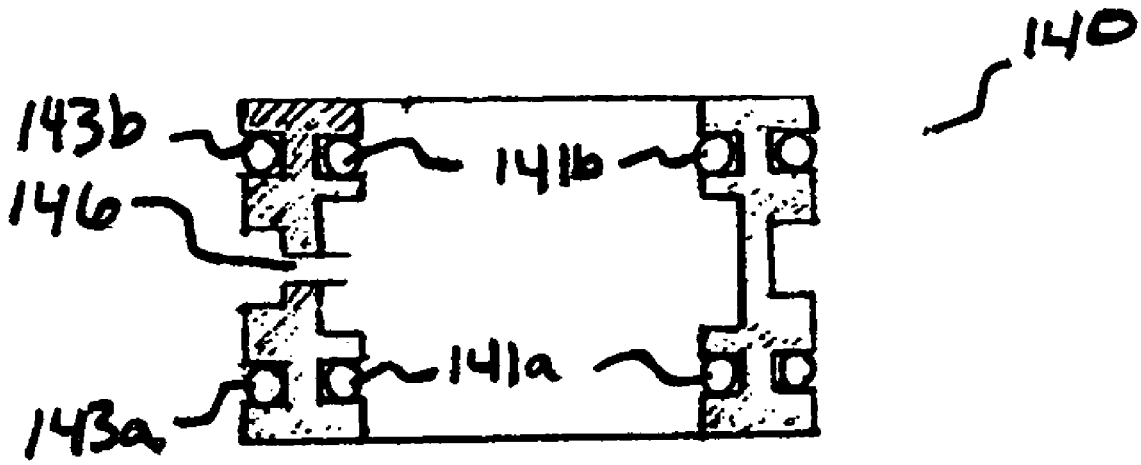
FIGS. 6-8 illustrate sealing devices according to an exemplary aspects of the present invention.
Figure 6:
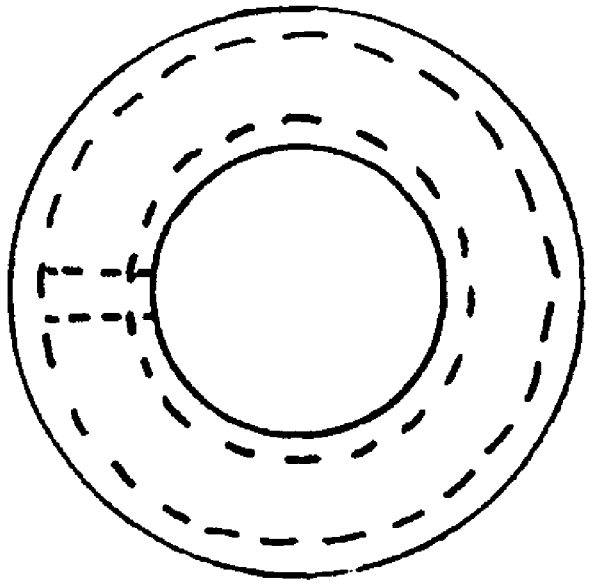
Figure 7:
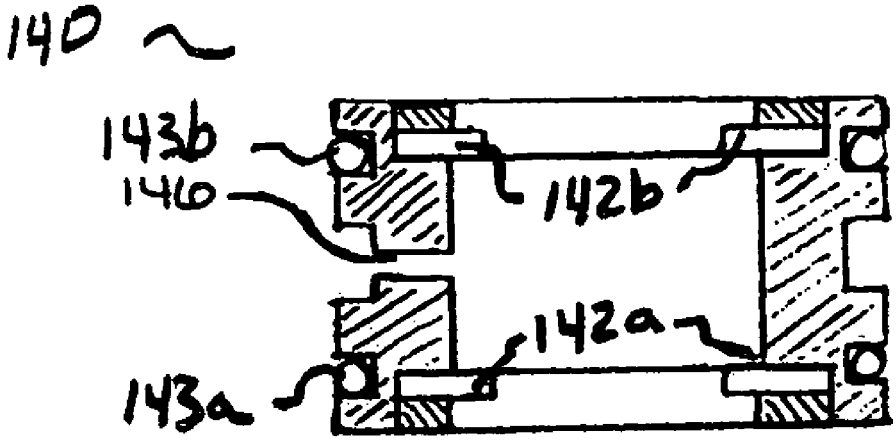
Figure 7:
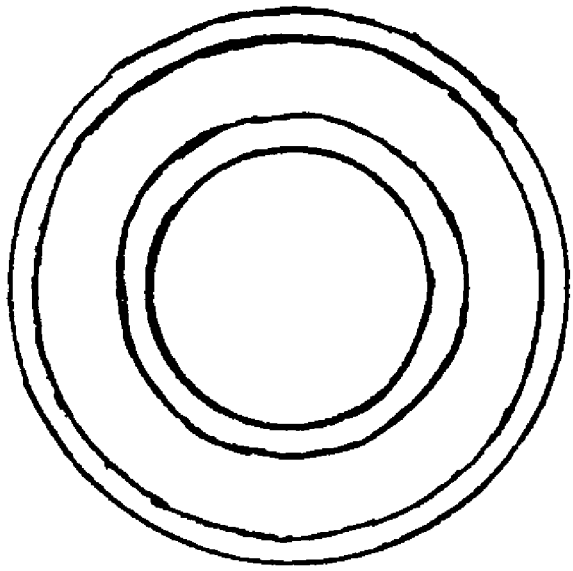
Figure 8:
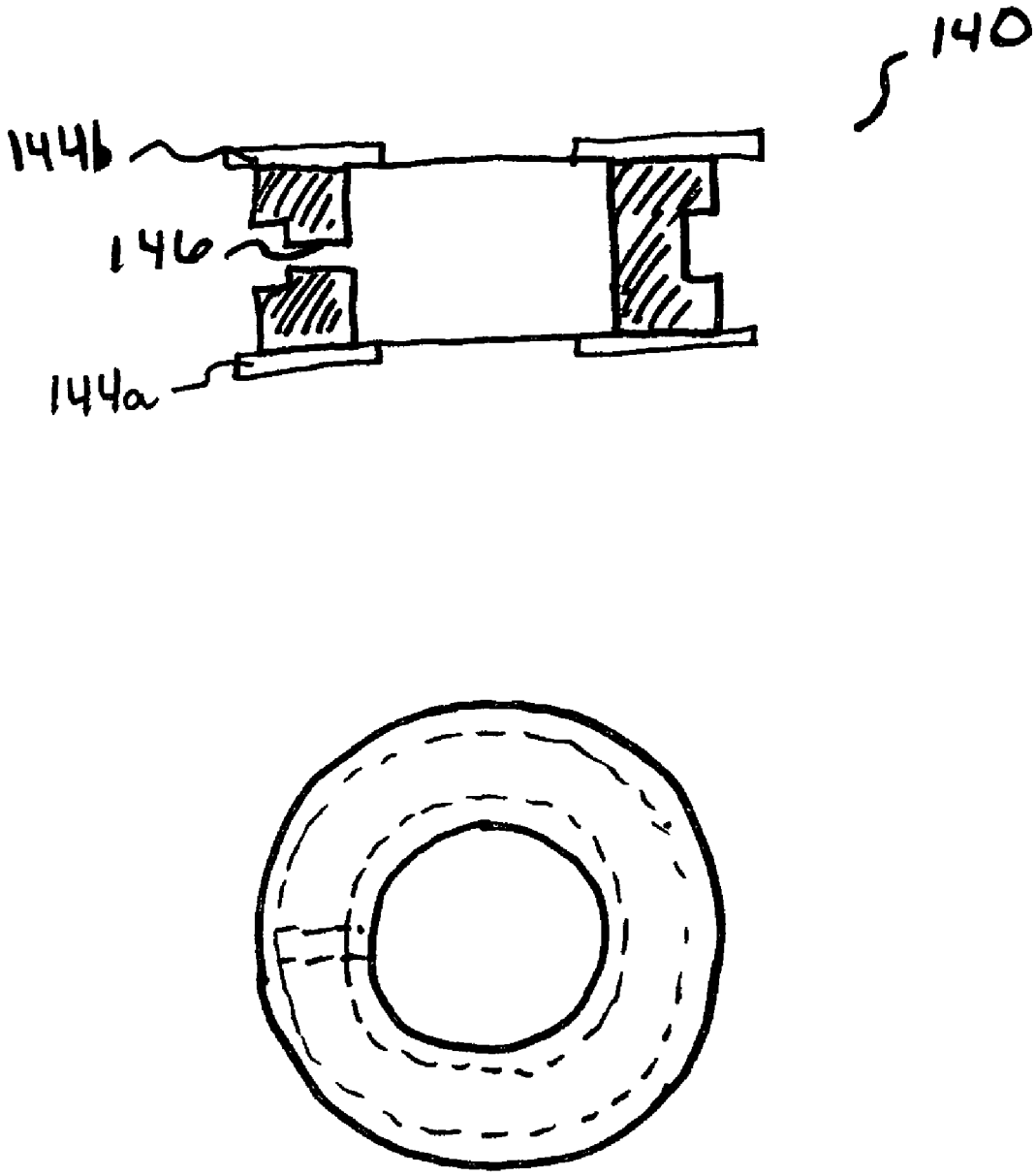

A sealing device 140, disposed within the fill fitting 120 above the nozzle stop 130, provides a first inner seal around the nozzle below the position of the hole 17 and a second inner seal around the nozzle above the position of the hole 17, when the nozzle is in the fill position. Exemplary sealing devices are illustrated in FIGS. 6-8. The sealing device 140 has a substantially cylindrical shape, including an inner cylinder in which the nozzle fits. The first and second inner seals may be provided for by means of first and second inner o-rings 141*a* and 141*b*, as shown in FIGS. 2 and 6, which may be disposed within grooves in the interior of the sealing device. Alternately, as shown in FIG. 7, the first and second inner seals may be provided for by means for first and second inner washers 142*a* and 142*b* fitted to the interior of the sealing device. The first and second inner seals provide an inner sealing space 145, around the hole 17 in the nozzle 10, between the nozzle 10 and the inner walls of the sealing device 140. Thus, the first and second inner seals may also be provided for by any other means as would be understood by one of skill in the art to create a first sealing space around the hole 17 in the nozzle 10.

The sealing device 140 includes a hole 146 positioned between the first and second inner seals. The sealing device also includes first and second outer seals which form seals respectively below and above the position of the hole 17 in the nozzle, when the nozzle 10 is in the fill position, and the hole 146 in the sealing device. Thus an outer sealing space 147 is created between the sealing device 140 and the inner walls of the fill fitting 120. The first and second outer seals may be provided for by means of first and second outer o-rings 143*a* and 143*b* (FIGS. 2, 6, and 7), or first and second washers 144*a* and 144*b* (FIG. 8), which may also provide the first and second inner seals. Thus, the first and second outer seals may also be provided for by any other means as would be understood by one of skill in the art to create a second sealing space, communicating with the first sealing space, between the outer walls of the sealing device 140 and the inner walls of the fill fitting 120. The hole 146 in the sealing device 140 is positioned between the first and second inner and outer seals such that when an inserted nozzle 10 is in the fill position, the hole 17 in the nozzle 10 rests between the first and second inner seals, and the hole 17 in the nozzle 10 communicates with the inner sealing space 145, which communicates with the outer sealing space 147 through the hole 146 in the sealing device 140.

Figure 9:
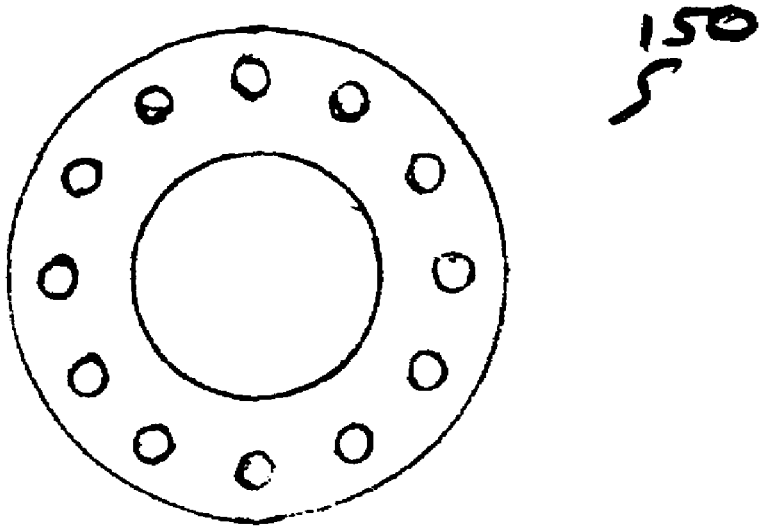
FIG. 9 illustrates a positioning sleeve according to an exemplary aspect of the present invention.
Figure 9:
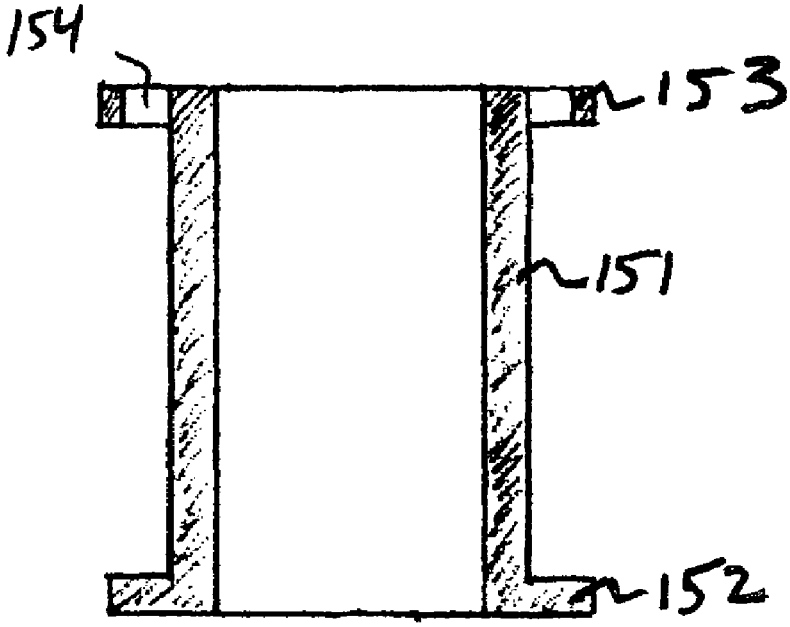

A positioning sleeve 150, disposed within the fill fitting 120 above the sealing device 140, fits around an upper portion of an inserted nozzle to maintain the nozzle in a properly-centered position. Alternately, the positioning sleeve 150 may maintain an inserted nozzle in a position which is off-center from the central axis of the fill tube, as needed, as would be understood by one of skill in the art. An exemplary positioning sleeve 150 is illustrated in FIG. 9. The positioning sleeve 150 includes a substantially cylindrical central portion 151 and upper and lower flanges 152 and 153. The upper flange 153 may include one or more holes 154, as discussed below. Alternately, the positioning sleeve 150 may be omitted and the sealing device 140 may function as a positioning sleeve.

According to exemplary aspects of the present invention, the nozzle stop 130, the sealing device 140, and the positioning sleeve 150 may be formed as one or two unified pieces, as illustrated in FIG. 2, or may be separate pieces, which are fitted together, as illustrated in FIGS. 3-9. The fill fitting 120, the positioning sleeve 150, the sealing device 140, and the nozzle stop 130 may be formed of aluminum, steel, stainless steel, brass, bronze, copper, plastic, epoxy, Marelon®, composite materials, ferrous or non-ferrous metals, or any combination thereof, or any other appropriate material as would be understood by one of skill in the art.

As mentioned above, and as illustrated in FIG. 2, the fill fitting 120 includes a hole 128, aligned between the first and second outer seals of the sealing device 140, thus communicating with the inner and outer sealing spaces 145 and 147.

A pressure transfer passage extends downward from the hole in the fill fitting into the tank. The pressure transfer passage 170, a lower hole 111 in the fill passage, the hole 128 in the fill fitting 120, the outer sealing space 147, the hole 146 in the sealing device 140, and the inner sealing space 145, thereby form a path from the interior of the fuel tank to the hole in the nozzle. The lower end 171 of the pressure transfer passage 170 is disposed at a predetermined level 175 within the fuel tank. The pressure transfer passage 170 may be formed from nylon or other plastics, copper, brass, steel, stainless steel, aluminum, or flexible hose, or any other appropriate material as would be understood by one of skill in the art. For systems on boats, materials which meet the American Boat and Yacht Council Standards, or are approved by the US Coast Guard for use in marine vessel fuel storage systems may be used.

As fuel is dispensed through the fill nozzle 10, through the fill passage 110, and into the tank 100, the fuel level rises in the tank. During fuel fill, the negative pressure in the nozzle passage 16 (described above with respect to FIG. 1) causes atmospheric air to flow (from an atmospheric vent in the tank, described later) through the pressure transfer passage 170, the lower hole 111 in the fill passage 110, the hole 128 in the fill fitting, the outer sealing space 147, the hole in the sealing device 146, the inner sealing space 145, the hole in the nozzle 17, and the nozzle passage 16. When the fuel level in the tank 100 has reached a the predetermined level 175, the fuel blocks off the lower end 171 of the pressure transfer passage 170. This closure of the lower end 171 of the pressure transfer passage stops 170 air flow through the pressure transfer passage and thereby creates a negative pressure in the nozzle passage 16. This negative pressure causes the diaphragm 12 to rise against the spring 13, and stops fuel flow through the nozzle 10, as described above with respect to FIG. 1.

As further illustrated in FIG. 2, the exemplary fuel spill avoidance system of this embodiment may also include a venting system 180.

The venting system 180 includes a tank vent passage 160 which extends from a lower end at the tank 100 to an upper end which communicates with the atmosphere through an upper hole 112 in the fill passage, an upper hole 129 in the fill fitting 120, and the at least one hole 154 the upper flange 153 of the positioning sleeve 150. The venting system 180 includes an atmospheric vent 165 which provides a means for air flow from the atmosphere into the tank 100 as fuel in the tank is depleted. The atmospheric vent 165 includes a first valve 163, which is a check valve permitting air flow only from the atmosphere into the tank and preventing air or fuel flow from the tank to the atmosphere. A second valve 162 is a pressure relief valve which prohibits air flow from the atmosphere to the tank, and which permits air flow to the atmosphere only at a pressure of 1-2 psi or greater. The combination of the first valve 163 and the second valve 162 enables air to enter the tank 100 as the fuel in the tank is consumed. Additionally, in case of a malfunction in the nozzle, the combination of valves prevents excess fuel from discharging through the atmospheric vent 165 and contaminating surrounding land or water. The pressure valve 162 enables flow through the atmospheric vent only in extreme cases, for example if the temperature in the fuel tank caused enough expansion to require additional air release.

Figure 10:
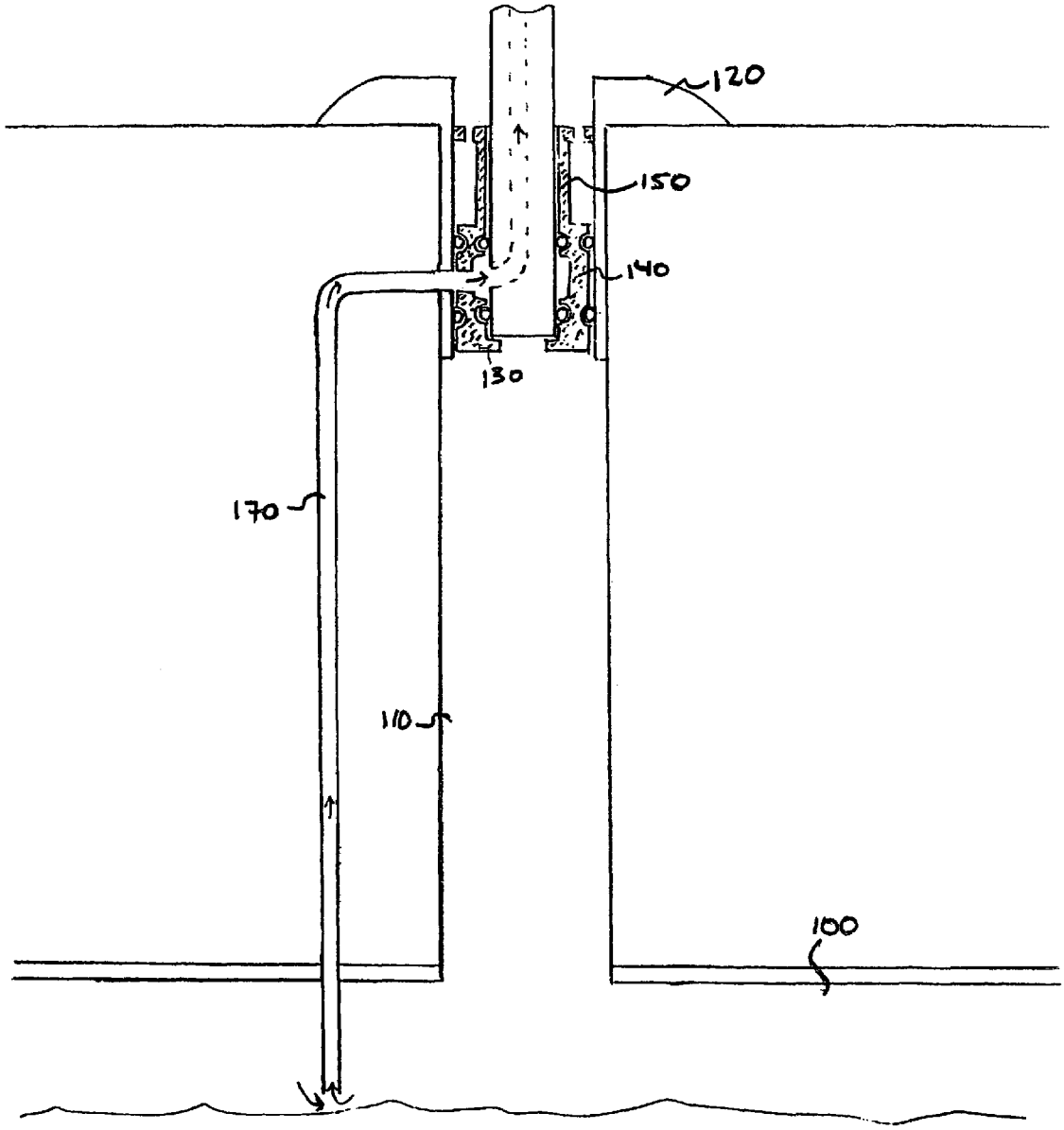
FIG. 10 illustrates a fuel spill avoidance system according to a second exemplary embodiment of the present invention.

FIG. 10 illustrates a second exemplary embodiment of the present invention including the fuel spill avoidance system without the above-described venting system. According this exemplary embodiment, the fuel spill avoidance system, including the positioning sleeve 150, the sealing device 140, the nozzle stop 130 and the pressure transfer passage 170 (described above with respect to the first embodiment), may be used in conjunction with a conventional vent (not illustrated) which provides a simple passage between the fuel tank and the atmosphere so that fuel and/or air may freely flow into or out of the tank at a location separate from the fill passage. According to this embodiment the one or more holes 154 in the upper flange 153 of the positioning sleeve 105 may or may not be included.

Figure 11:
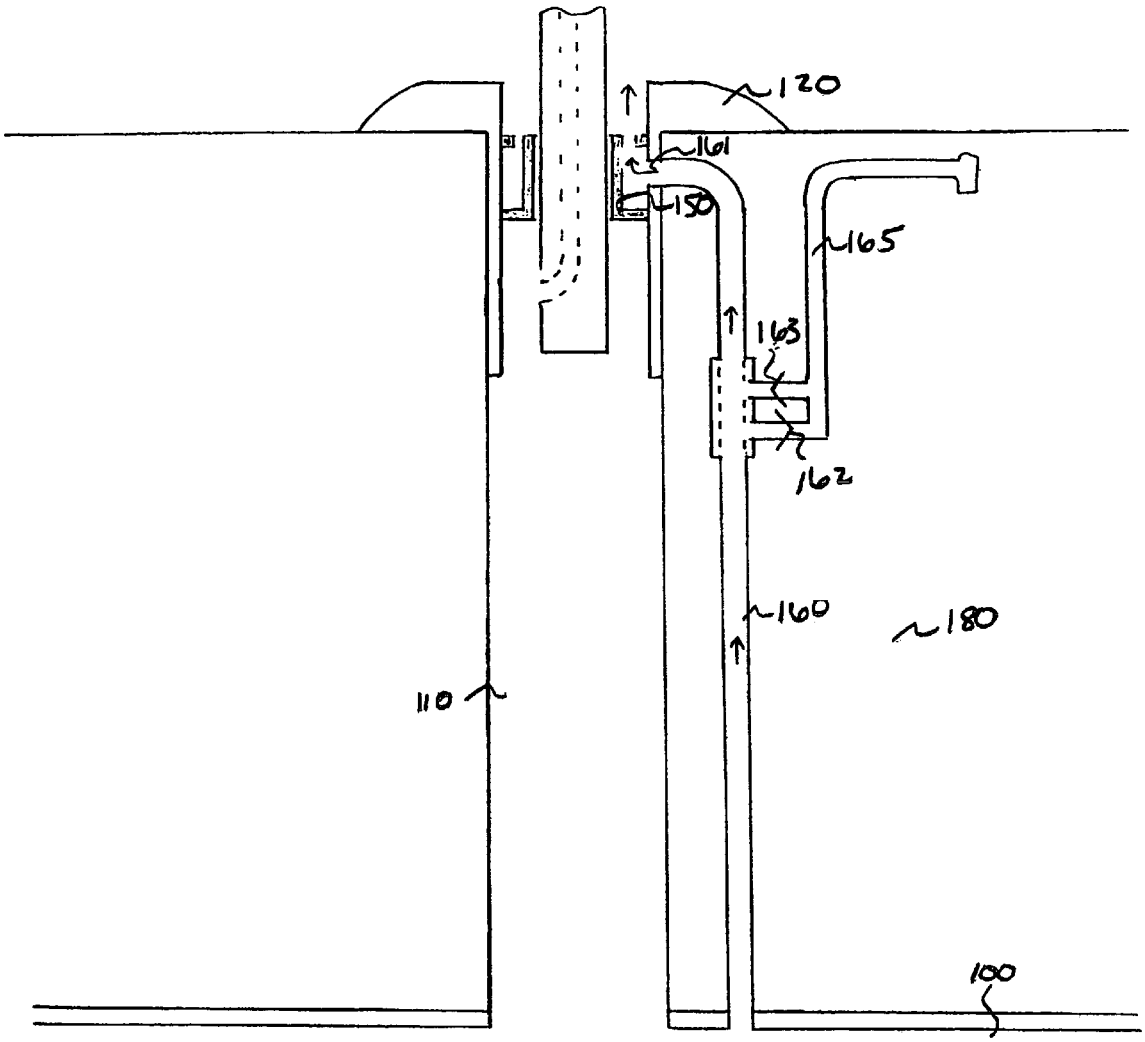
FIG. 11 illustrates a venting system according to a third exemplary embodiment of the present invention.

FIG. 11 illustrates a third exemplary embodiment of the present invention including the venting system 180, as described with respect to the first exemplary embodiment, without the above-described fuel spill avoidance system. According to this embodiment, the above-described exemplary venting system of the present invention, including the upper hole 112 in the fill passage, the positioning sleeve 150 having at least one hole 154 in an upper flange 153 thereof, the upper hole 129 in the fill fitting, the tank vent passage 160, and the atmospheric vent 165, including the first and second valves 163 and 162 may be utilized separately from the above-described fuel spill avoidance system.

Figure 12:
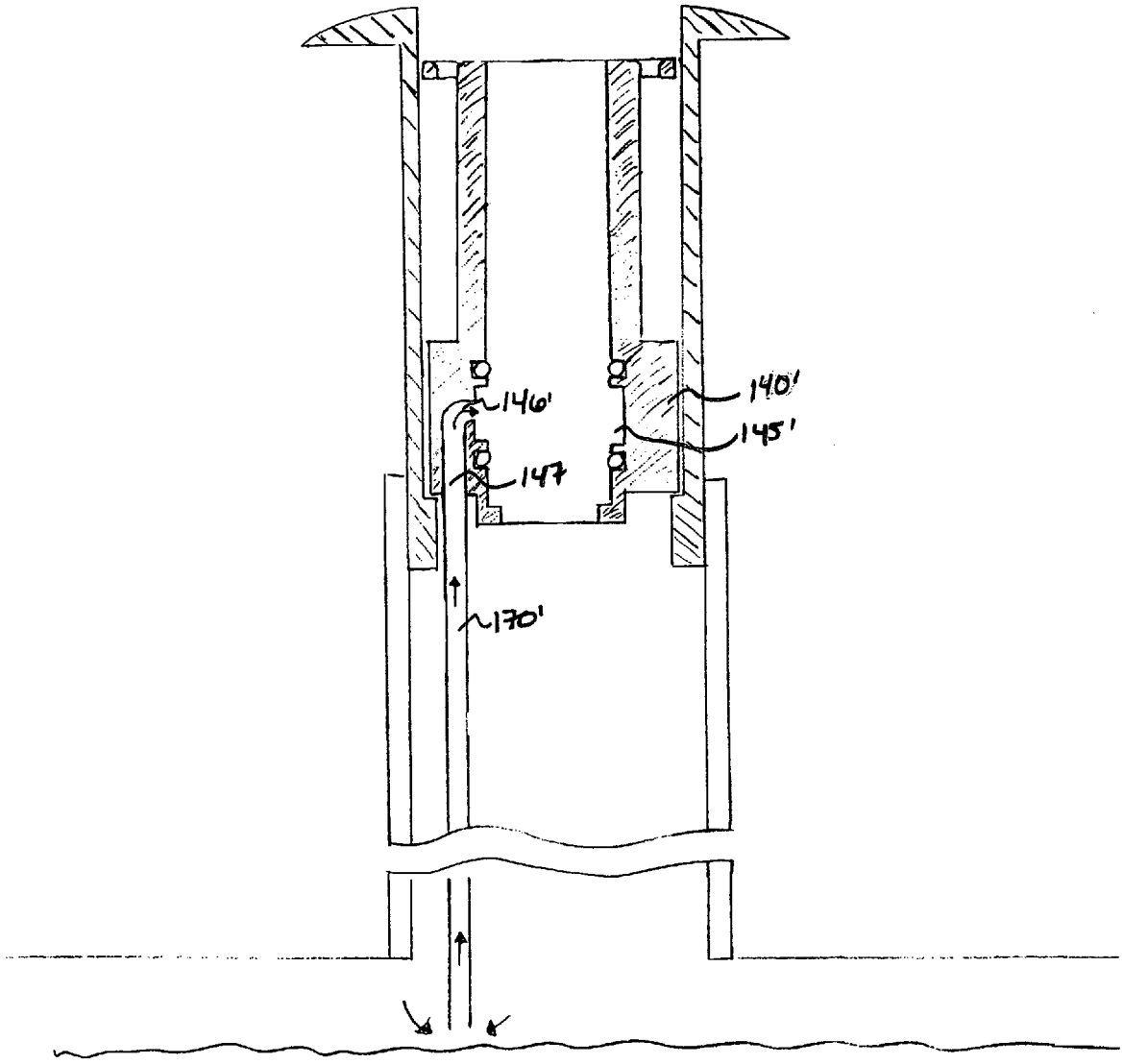
FIG. 12 illustrates a sealing device and a communicating passage according to a fourth exemplary embodiment of the present invention.

FIG. 12 illustrates a sealing device 140' and a communicating passage 170' according to a fourth exemplary embodiment of the present invention. According to the fourth exemplary embodiment of the present invention, no lower hole in the fill fitting 120 is used. Additionally, the hole in the sealing device and the upper and lower outer seals are not used. Rather, the inner sealing space 145' of the sealing device communicates with a passage 147' through the body of the sealing device 150', which is attached to the pressure transfer passage 170', as shown.

Although the above exemplary embodiments and aspects of the present invention have been described, it will be understood by those skilled in the art that the present invention should not be limited to the described exemplary embodiments, but that various changes and modifications can be made within the spirit and scope of the present invention without departing from the spirit and scope of the present invention as defined by the following claims.

What is claimed is:

1. A system for preventing overflow in a storage tank which is fillable via a nozzle, the system comprising:

a fill passage connecting the storage tank to an external atmosphere;

a fill fitting comprising:

a mounting flange and a sleeve, wherein the mounting flange rests outside the external end of the fill passage and the sleeve fits within the fill passage;

a nozzle stop, disposed within the sleeve of the fill fitting, having an internal lip, wherein the inner diameter of the lip is less than the outer diameter of an end of the nozzle;

a sealing device, disposed within the sleeve of the fill fitting above the nozzle stop, the sealing device comprising a first inner seal and a second inner seal and a first outer seal and a second outer seal and a hole in a wall of the sealing device between the first inner and outer seals and the second inner and outer seals;

a pressure transfer passage having a first end disposed at a specific level within the storage tank and a second end communicating with a hole in the fill passage and a corresponding hole in the fill fitting;

wherein the nozzle is in a fill position when the end of the nozzle is in contact with the nozzle stop;

when the nozzle is in the fill position, the first inner seal forms a seal around the nozzle below a hole in the nozzle and below the hole in the sealing device and the second inner seal forms a second seal around the nozzle above the hole in the nozzle and above the hole in the sealing device, thereby forming an inner sealing space;

when the nozzle is in the fill position, the first outer seal forms a seal between the sealing device and the fill fitting below the hole in the sealing device and below the hole in the fill fitting and the second outer seal forms a seal above the hole in the sealing device and above the hole in the fill fitting.

2. The system according to claim 1, further comprising a positioning sleeve, disposed within the fill fitting above the sealing device, the positioning sleeve comprising a substantially cylindrical central portion, an upper flange, and a lower flange, wherein the inner diameter of the central portion is larger than the outer diameter of the nozzle.

3. The system according to claim 2, wherein:

there is at least one hole in the upper flange of the positioning sleeve;

there is a hole in the fill fitting and a corresponding hole in the fill passage, which are positioned between the upper and lower flanges of the positioning sleeve;

the system further comprises:

a tank vent passage between the storage tank and the corresponding holes in the fill fitting and the fill passage between the upper and lower flanges of the positioning sleeve, capable of transmitting air from the storage tank to the atmosphere;

an atmospheric vent passage between the tank vent passage and the external atmosphere, connected to the tank vent passage via first and second valves;

wherein the first valve is a check valve which permits the passage of air from the atmosphere to the tank vent passage, but does not permit passage of air from the tank vent passage to the atmosphere; and wherein the second valve is a pressure relief valve which permits passage of air or fuel at a pressure of greater than or equal to a specific pressure from the tank vent passage to the atmosphere and prevents passage of air or fuel at a pressure of less than the specific pressure.

4. The system according to claim 3, wherein the specific pressure is 1 psi or greater.

5. The system according to claim 1, wherein the first inner seal, the second inner seal, the first outer seal, and the second outer seal are each one of:

one or more flexible O-rings, and a flexible washer.

6. A system for preventing overflow in a storage tank which is fillable via a nozzle inserted in a fill passage, the system comprising:

a nozzle stop, disposed within the fill passage, wherein the nozzle is in a fill position when an end of the nozzle is in contact with the nozzle stop;

a sealing device, disposed within the fill passage above the nozzle stop, comprising a first inner seal and a second inner seal, wherein, when the nozzle is in the fill position, the first inner seal forms a seal around the nozzle above a hole in the nozzle and the second inner seal forms a seal around the nozzle below the hole in the nozzle, thus forming an inner sealing space; and an airtight passage between the inner sealing space and an interior of the storage tank;

wherein the sealing device further comprises a hole disposed between the first inner seal and the second inner seal; and a first outer seal below the hole and a second outer seal above the hole, thereby forming an outer sealing space; and wherein the passage between the inner sealing space and the storage tank comprises the hole in the sealing device, the outer sealing space, a hole in the fill passage, and a pressure transfer passage between the hole in the fill passage and the storage tank.

7. The system according to claim 6, wherein the first inner seal, the second inner seal, the first outer seal, and the second outer seal are each one of:

one or more flexible O-rings, and a flexible washer.

8. A venting system for a storage tank, comprising:

a fill passage connecting the storage tank to an external atmosphere and having a hole therein;

a fill fining comprising a sleeve fitted within the fill passage and having a hole therein corresponding to the hole in the fill passage;

a positioning sleeve, disposed within the fill fitting, comprising:

a substantially cylindrical central portion having an inner diameter larger than an outer diameter of a fill nozzle, an upper flange having at least one hole therein, and a lower flange, wherein the holes in the fill passage and in the fill fitting lie between the upper and lower flanges of the positioning sleeve;

a tank vent passage between the storage tank and the hole in the fill passage, such that the storage tank communicates with the external atmosphere via the tank vent passage, the hole in the fill passage, the hole in the fill fitting, and the hole in the upper flange of the positioning sleeve; and an atmospheric vent passage between the tank vent passage and the external atmosphere, connected to the tank vent passage via first and second valves;

wherein the first valve is a check valve which permits passage of air from the atmosphere to the tank vent passage, but does not permit passage of air from the tank vent passage to the atmosphere; and wherein the second valve is a pressure relief valve which permits passage of air at a pressure of greater than or equal to a specific pressure from the tank vent passage to the atmosphere and prevents passage of air at a pressure of less than the specific pressure.

9. The system according to claim 8, further comprising at least one hole in the lower flange of the positioning sleeve.

10. The system according to claim 8, wherein the specific pressure is 1 psi or greater.

* * * * *